US005141347A

United States Patent [19]

Fitjer

[11] Patent Number: 5,141,347

[45] Date of Patent: Aug. 25, 1992

[54] RESERVOIR WITH POSITIONING SLEEVE FOR CLOSURE CAP

[75] Inventor: Holger Fitjer, Ansbach, Fed. Rep. of Germany

[73] Assignee: Georg Karl Geka-Brush GmbH, Bechhofen-Waizendorf, Fed. Rep. of Germany

[21] Appl. No.: 632,208

[22] Filed: Dec. 21, 1990

[30] Foreign Application Priority Data

Jan. 31, 1990 [FR] France ..... 90 01152

[51] Int. Cl.[5] ..... A45D 34/00; B65D 41/04

[52] U.S. Cl. ..... 401/126; 401/122; 401/129; 215/330; 215/331; 220/319

[58] Field of Search ..... 220/319; 215/274, 273, 215/330, 331; 401/122, 265, 126, 129

[56] References Cited

U.S. PATENT DOCUMENTS 3,374,928 3/1968 Hope ..... 401/265 X
3,977,557 8/1976 Hazard ..... 220/319 X
4,061,239 12/1977 Tasseron ..... 215/273
4,071,157 1/1978 Apellaniz ..... 220/319 X
4,470,425 9/1984 Gueret ..... 401/122 X
4,761,088 8/1988 Zubek ..... 401/122

FOREIGN PATENT DOCUMENTS 8712015 9/1987 Fed. Rep. of Germany .

*Primary Examiner*—Steven A. Bratlie
*Attorney, Agent, or Firm*—Browdy and Neimark

[57] ABSTRACT

The invention relates to a reservoir for cosmetics, in particular a mascara unit, comprising a main body of a comparatively soft plastic material, with a threaded neck, on which a screw cap can be screwed, with at least one stop shoulder and at least one return stop in the form of a locking arrangement being provided at the foot of the threaded neck at the shoulder of the reservoir to achieve a defined end position of the screw cap. In order to overcome the wear problems with such soft plastic material which are encountered by known devices, it is provided that an attachment of a comparatively hard material is arranged on the reservoir at the foot of the threaded neck, on which attachment the stop shoulder and the return stop are formed.

10 Claims, 1 Drawing Sheet

RESERVOIR WITH POSITIONING SLEEVE FOR CLOSURE CAP

FIELD OF THE INVENTION

The invention relates to a reservoir for cosmetics, in particular a mascara unit, comprising a main body formed of a comparatively soft material, in particular of a comparatively soft plastic material, with a threaded neck, on which a screw cap can be screwed, with at least one stop shoulder and at least one return stop in the form of a locking arrangement provided at the foot of the threaded neck at the shoulder of the reservoir to achieve a defined end position of the screw cap.

BACKGROUND OF THE INVENTION

As a rule, reservoirs for cosmetics of the kind described above have a rectangular or oval, but in any way not circular symmetrical cross-section, so that achieving an attractive appearance, in the closed state substantially depends on insuring that the external walls of the screw cap and the reservoir are in exact alignment or are oriented one in relation to the other in a defined manner. In principle, the same is true for reservoirs or screw caps of circular cross section with a label continuously extending over both, the reservoir and the cap, which equally requires an exact positioning of the screw cap. This is achieved in that at least one stop shoulder is provided limiting the end position in a defined manner, and a return stop is provided, which as a rule consists of a locking projection and a locking recess, and which prevents the screw cap from returning from its position where it rests against the stop shoulder. Various embodiments of such an arrangement are known, such as German utility model 87 12 015.

With reservoirs of comparatively hard plastic materials this closing technique has shown excellent results. However, problems come up with the use of reservoirs of softer plastics, for example of polypropylene, polyethylene, low-pressure polyethylene, acrylo-nitrile butadiene styrene co-polymers (ABS) or polyethylene terephthalate. The use of such plastics is necessary or desirable for example with highly aequous liquids because of the more favorable barrier properties of these softer plastic materials. In the case of such comparatively soft plastic materials the return stop as well as the stop shoulder are found to be subject to a comparatively high wear, in that the comparatively soft plastic material is worn off and deformed after a few closings, so that the desired defined closing position is no longer realized.

SUMMARY OF THE INVENTION

It is the object of the present invention to embody a reservoir of the above generic type in such a way that its qualities of use remain unchanged, even when comparatively soft plastic materials are used for the reservoir and even when the closing system is more often or frequently actuated.

In accordance with the invention this object is solved by an attachment of a comparatively hard material arranged on the reservoir at the foot of the threaded neck, on which attachment the stop shoulder and the return stop are formed. This solution deviates from the efforts of those skilled in the art who tend to prefer an integral realization of a reservoir wherever possible in plastics technical designs. Rather, a two-part realization is deliberately taken into account, so as to achieve truly reliable qualities of use of such reservoirs, which are as a rule used for superior products, with an advantage in terms of manufacturing technique resulting as a side-effect, namely that the position of the stop shoulder and the return stop need not be considered when the blow mold or injection mold for the reservoir is designed.

In a refinement the attachment can be provided to have a sleeve-shaped neck overlapping the top side of the reservoir. Consequently, the attachment can simply be slipped over the reservoir.

In this regard provision is advantageously made for the top side of the reservoir to have a reduced diameter in the vicinity of the sleeve neck, so that the outside of the sleeve neck and of the reservoir are in alignment when assembled.

The attachment is preferably made of metal or of a comparatively hard plastic material. The use of metal for manufacturing improves the qualities of use and may at the same time have a decorating effect.

In construction using a plastic material, polyamide or polyoxymethylene, polyformaldehyde, polyethylene terephthalate or polyacetal, in particular in metallized form, may for instance be considered. A gold or silver metallization is preferably considered. Even without any metallization a decorating effect may be achieved by using another plastic material. Contrary to conventional decorating methods, such as all-round embossing, the reservoir shoulder itself can also be decorated.

In an advantageous embodiment the screw cap may have a threaded insert of a comparatively hard plastic material. In the case of such a threaded insert the barrier properties practically need not be taken into account, which is different with the reservoir. Consequently, the wear of the screw-cap counterparts of the stop shoulder and the return stop can be prevented by the choice of a comparatively hard plastic material.

A further advantageous provision consists in that a mascara applicator is secured to the insert. The applicator can be injection molded integrally with the insert.

In the case of a design of a round cross-section provision can be made for the attachment to be slipped over the reservoir by form locking and non-rotatably, with for instance rib-groove arrangements extending parallel to the longitudinal axis being provided to this effect. In the case of out-of-round cross-sections such an alignment results automatically. The alignment of the attachment in relation to the reservoir is important, because the stop shoulder and the return stop must be in a defined position relative to the reservoir thread, in particular to the thread start.

Further advantages and features of the invention will become apparent from the ensuing description of an examplary embodiment, taken in conjunction with the drawings.

DESCRIPTION OF THE PREFERRED EMBODIMENT

Figure 1:
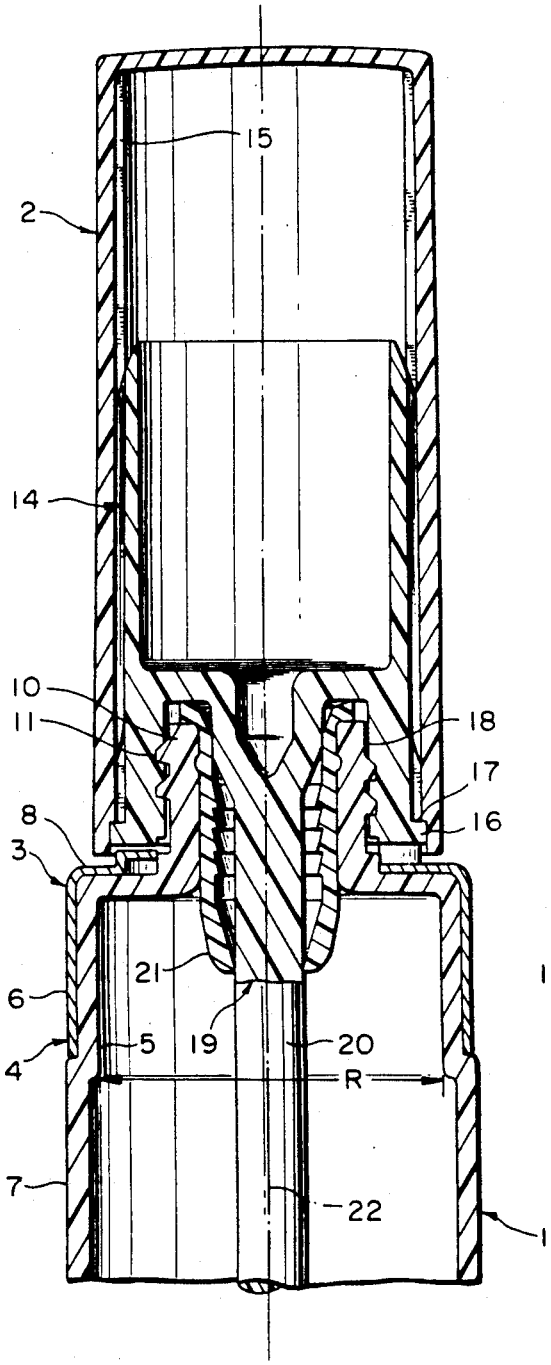
FIG. 1 is a longitudinal section through the top side of a reservoir with a screw cap according to the invention.
Figure 2:
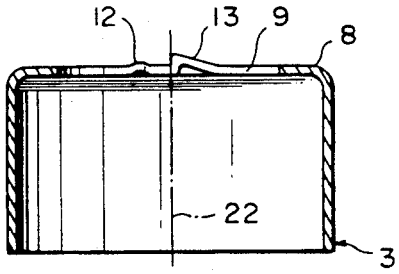
FIG. 2 is a section through the reservoir attachment in an aspect turned by 90° relative to FIG. 1.
Figure 3:
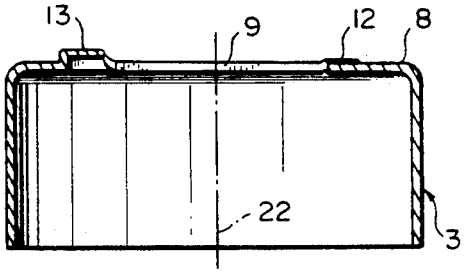
FIG. 3 is a section through the attachment according to the direction in FIG. 1.
Figure 4:
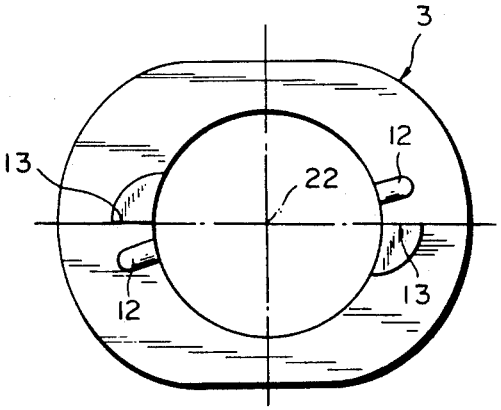
FIG. 4 is a top view of the top side of the attachment.

A reservoir 1 shown in the drawing is provided with a screw cap 2, both reservoir and screw cap having an outer contour practically formed by two segments of circle connected by two parallel straight lines, i.e. the outer contour is not round, and for achieving a favorable optical appearance it is important that, when closed, the screw cap 2 is positioned exactly on the reservoir 1.

An attachment 3, which is made of metal in the illustrated embodiment, is slipped over the reservoir 1. The attachment 3 comprises a sleeve-like neck 4 overlapping the top side 5 of the reservoir 1, the dimension R at this top side 5 (see FIG. 1) tapering in relation to the rest of the reservoir 1, so that the external surfaces 6 and 7 of the sleeve neck 4 or of the reservoir 1, respectively, are in alignment.

The sleeve neck 4 is followed by a section 8 extending essentially radially and surrounding a recess 9 for a threaded neck 10 with an external thread 11 of the reservoir 1.

Two return stop projections 12 and two stop shoulders 13 for stabilizing the end position of the cap 2 on the neck 4 are formed on the radially extending section 8 and are staggered by 180°, the stop shoulders 13 extending parallel to the longitudinal axis 22 of the attachment 3 or of the reservoir 1.

The screw cap 2 has an insert 14 plugged in, which is radially secured to the screw cap 2 by way of retaining ribs 15 arranged on the inside of the cap 2 and which is axially secured to the screw cap 2 by way of a stop collar 16 in connection with a stop shoulder 17.

The lower inside of the cylindrical main body of the insert 14 has a threaded section 18 with a thread corresponding to the external thread 11.

An applicator or a holder for an applicator 19 is formed on the insert 14. The retaining handle of the applicator 19 is in per se known manner surrounded by a sealing insert 21 equally made of plastic material.

The insert 14 is made of a comparatively hard plastic material and thus resistant to wear, i.e. it is for example made of hard PVC.

What is claimed is:

1. A container for cosmetics, in particular a mascara unit, comprising:

a main body of a comparatively soft plastic material defining a reservoir, said main body having a threaded neck on which a screw cap can be screwed, an attachment (3) of a hard material disposed over an upper portion of said main body and about said threaded neck so that a bottom edge of the screw cap will contact said attachment.

said attachment (3) having at least one stop shoulder thereon and at least one return stop thereon, said stop shoulder and said return stop comprising an end-position stabilizing arrangement below the threaded neck of said main body for achieving a defined end position of the screw cap.

2. A container according to claim 1, wherein the attachment (3) has a sleeve-shaped neck (4) overlapping the top side (5) of the soft main body.

3. A container according to claim 2, wherein the top side (5) of the soft main body has a reduced dimension R in the vicinity of the sleeve neck (4).

4. A container according to claim 1, wherein the attachment (3) is made of metal.

5. A container according to claim 1, wherein the screw cap (2) has a threaded insert (14) of a comparatively hard plastic material.

6. A container according to claim 5, wherein an applicator (19) is secured to the insert (14).

7. A container according to claim 1, wherein the attachment (3) is made of a hard plastic material.

8. A container according to claim 1, wherein the attachment (3) is made of a soft plastic material hardened by a metallization of its surface.

9. A container according to claim 8, wherein the attachment (3) is made of a metallized plastic selected from the group consisting of polyamide, polypropylene and polyethylene.

10. A container for containing aqueous cosmetics, in particular a mascara unit, capable of repeated openings and closings, comprising:

a main body of a comparatively soft and deformable plastic material having good barrier properties for aqueous cosmetics, defining a reservoir, said main body having a threaded neck on which a screw cap can be repeatedly screwed and unscrewed, an attachment (3) of a hard material disposed over an upper portion of said main body and about said threaded neck, said attachment (3) having at least one stop shoulder thereon and at least one return stop thereon, said stop shoulder and said return stop comprising an end-position stabilizing arrangement below the threaded neck of said main body for achieving a defined end position of the screw cap, wherein said attachment (3) is shaped so as to slip over the threaded neck of said main body and engage with said upper portion in a non-rotatable manner.

* * * * *